United States Patent [19]

Vitello et al.

[11] 4,296,785

[45] Oct. 27, 1981

[54] SYSTEM FOR GENERATING AND CONTAINERIZING RADIOISOTOPES

[75] Inventors: John P. Vitello, Weston, Mass.; Glenn D. Grummon, Richmond Heights, Mo.

[73] Assignee: Mallinckrodt, Inc., St. Louis, Mo.

[21] Appl. No.: 55,784

[22] Filed: Jul. 9, 1979

[51] Int. Cl.[3] ..... B65B 3/04

[52] U.S. Cl. ..... 141/105; 137/625.47; 141/279; 141/305; 141/329; 250/432 PD

[58] Field of Search ..... 137/625.47; 128/272.3, 128/274, 214 B; 141/59, 10 D, 105, 107, 279, 284, 285, 301, 302, 305, 329, 392; 222/481, 481.5; 250/432 PD

[56] References Cited

U.S. PATENT DOCUMENTS 3,635,981 4/1972 Montgomery et al. ..... 250/432 PD

*Primary Examiner*—Frederick R. Schmidt

*Attorney, Agent, or Firm*—Senniger, Powers, Leavitt and Roedel

[57] ABSTRACT

A system for eluting a daughter radioisotope from a parent radioisotope and containerizing the resultant eluate in an evacuated container having a rubber stopper, providing for delivery of eluant from a reservoir through a charge of the parent radioisotope in a generator and thence to a tubular needle adapted to be pierced through the stopper of the evacuated container for suctioning the eluant from the sealed eluant supply into the generator and for suctioning the resultant eluate into the container. The needle is at the lower end of a valve body having a valve plug rotatable therein between a closed and open position. The plug is adapted to be pushed down to push the valve body down to cause the needle to pierce the stopper, after which the plug is rotated to open position, in which it effects venting of the eluant reservoir to atmosphere, delivery of eluant from the reservoir to the generator, and delivery of eluate from the generator to the needle.

10 Claims, 6 Drawing Figures

SYSTEM FOR GENERATING AND CONTAINERIZING RADIOISOTOPES

BACKGROUND OF THE INVENTION

This invention relates to a system for generating and containerizing radioisotopes, and more particularly to apparatus for the generation and containerization under sterile conditions of radioactive isotope solutions such as are obtained as the eluate in a radioisotope generator system.

Reference may be made to the coassigned U.S. Pat. No. 3,655,981, issued Apr. 11, 1972, entitled Closed System Generation and Containerization of Radioisotopes for Eluting a Daughter Radioisotope from a Parent Radioisotope, disclosing a system for the preparation and packaging, under sterile conditions, of a solution of a daughter radioisotope, such as technetium-99M, generated from a parent radioisotope, such as molybdenum-99, wherein the daughter radioisotope is eluted from a parent radioisotope contained in a generator with an anion exchange medium or other medium, such as alumina, having a high adsorptive capacity for the parent but a low adsorptive capacity for the daughter, by washing with a suitable solvent or eluant such as a sterile, pyrogen-free isotonic saline solution. The present invention involves improvements over the prior system.

SUMMARY OF THE INVENTION

Among the several objects of this invention may be noted the provision of an improved system for generating and containerizing radioisotopes which, while enabling use of a reservoir for the eluant with an air vent for atmospheric pressurization of the eluant in the reservoir for delivery of the eluant from the reservoir, inhibits leakage of eluant from the generator of the system; the provision of such a system for generating and containerizing radioisotopes under sterile conditions; and the provision of such a system which is easy to use.

In general, the system of this invention, which is operable for eluting a daughter radioisotope from a parent radioisotope and for containerizing the resultant eluate in an evacuated container having a closure adapted to be pierced by a needle, comprises a generator containing a supply of the parent radioisotope, the generator having an inlet for an eluant for eluting the daughter radioisotope from the parent radioisotope and an outlet for the resultant eluate, a reservoir for holding a supply of the eluant, the reservoir having an outlet for delivery of eluant to the inlet of the generator and an air inlet for admission to the reservoir of air from the atmosphere to apply atmospheric air pressure to eluant in the reservoir, a tubular needle for piercing the closure of an evacuated container, and valve means comprising a first port constituting an air inlet in communication with the atmosphere, a second port in communication with said reservoir air inlet, a third port interconnected with said reservoir outlet, a fourth port interconnected with said generator inlet, a fifth port interconnected with said generator outlet for delivery of eluate to the needle, and means for blocking communication between said first and second ports, between said third and fourth ports, and between said fifth port and the needle, and operable to place the first port in communication with the second, the third in communication with the fourth and the fifth in communication with the needle.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
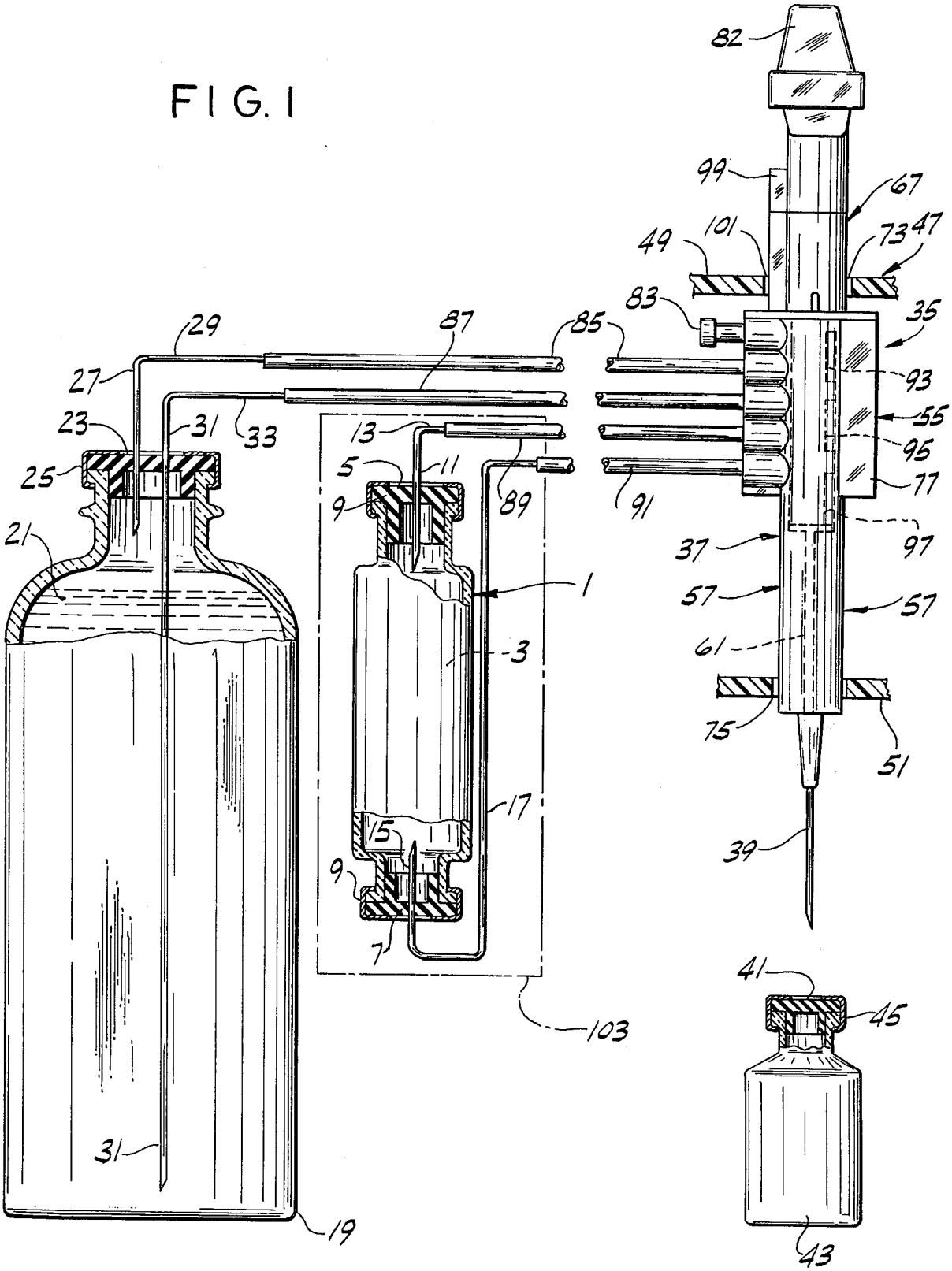
FIG. 1 is a view of a system of this invention showing the eluant reservoir and generator of the system and valve means of the system operable to cause a tubular needle to pierce the stopper of an evacuated container and then operable for flow of eluant from the reservoir to the generator and flow of eluate from the generator through the needle into the container.

Referring to the drawings, first more particularly to FIG. 1, a system of this invention for generating and containerizing radioisotopes is shown to comprise a generator 1 containing a sterile pyrogen-free supply 3 of a parent isotope. Generally, this generator comprises an elongate cylindric glass tube having pierceable closures 5 and 7 at its upper and lower ends (upper and lower as shown in FIG. 1) each constituted by a rubber stopper plugged in the respective end of the container. An aluminum foil cover 9 is shown for each stopper with a central circular section of the cover removed. The parent radioisotope may be molybdenum-99, for example, adsorbed on an anion exchange medium, alumina or other medium (as in U.S. Pat. No. 3,655,981) for generating technetium-99M. The generator could be a tin/indium or germanium/gallium generator. Pierced through the rubber stopper at the upper end of the generator is the downturned end 11 of a relatively thin metal tube 13 constituting an eluant inlet for the generator. Pierced through the rubber stopper at the lower end of the generator is the upturned end 15 of a relatively thin metal tube 17 constituting an eluant outlet for the generator.

At 19 is shown a reservoir for holding a supply of eluant 21 (e.g., saline solution). Preferably, this is a glass bottle having a rubber stopper 23 in its mouth with an aluminum foil cover 25 for the stopper, shown in FIG. 1 with a central circular section of the cover removed. Pierced through the stopper 23 is the downturned end 27 of a relatively thin metal tube 29 constituting an air inlet for the reservoir or bottle, for admission of air to the bottle to apply atmospheric air pressure on the eluant 21 in the bottle. Also pierced through the stopper 23 is the downturned leg 31 of a thin metal tube 33 constituting an eluant outlet for the bottle. The downturned leg 31 of the tube 33 extends down in the bottle nearly to the bottom of the bottle for the delivery of eluant upwardly through the leg 31.

At 35 is indicated a valve means comprising a valve body 37 carrying a tubular needle 39 for piercing the rubber stopper 41 of a sealed sterile evacuated container or vial 43, shown in FIG. 1 as having an aluminum foil cover 45 from which a removable circular central section has been removed leaving an opening in the cover. Means indicated generally at 47, which may comprise part of a case corresponding generally to the case shown in U.S. Pat. No. 3,655,981, mounts the valve body for movement downwardly from its raised retracted position of FIGS. 1 and 2, for causing the needle to pierce the rubber stopper or closure 41 of the evacuated container 43, and for movement back up to its raised retracted position. The means 47 comprises an overhanging portion of the case, having top and bottom walls 49 and 51 and an outer wall 53.

Figure 6:
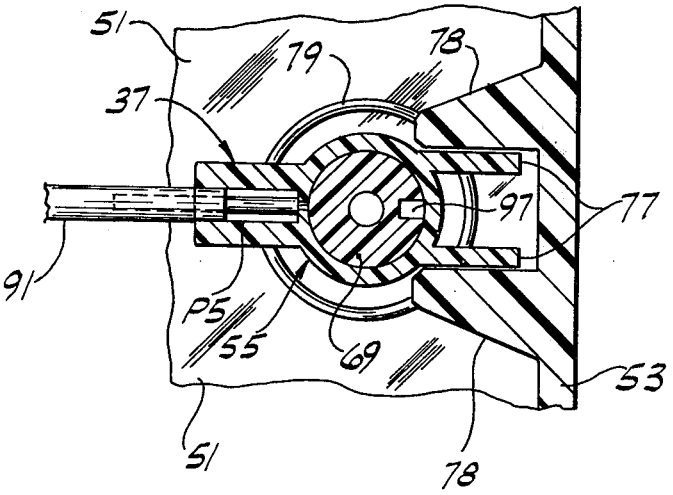
FIG. 6 is a horizontal section on line 6—6 of FIG. 2.

The valve body has an upper section 55 and a lower section 57 extending down from the upper section. The upper section is formed to provide a cylindrical recess 59 extending down from its upper end, and the lower section is formed to provide a passage 61 of smaller circular cross section than the circular cross section of recess 59 extending down from the bottom of the recess to the lower end of the lower section. The passage 61 is enlarged at its lower end as indicated at 63 for reception of an enlarged head 65 at the upper end of the needle 39. At 67 is indicated a valve member having a lower cylindrical section 69 constituting a valve plug having a rotary sealing fit in the recess 59, and an enlarged upper section or plug extension 71, the lower end of the latter engaging the upper end of the valve body. Extension 71 of the plug 69 is vertically slidable in an opening 73 in the top wall 49 of the overhang 47, and section 57 of the valve body is vertically slidable in an opening 75 in the bottom wall 51 of the overhang. Section 55 of the valve body has a pair of ribs 77 slidable between lugs 78 on the inside of wall 53 (see particularly FIG. 6) to guide the valve body and hold it against rotation on its vertical axis. A spring 79 biases the valve body (and plug) upwardly to their raised retracted position of FIGS. 1 and 2, which is determined by engagement of the upper end of the valve body with first and second stops 80 and 81 on the bottom of wall 49. The plug extension 71 has a knob 82 keyed to it at its upper end for turning it.

The upper section 55 of the valve body has a vertical series of five ports therein extending between the cylindrical recess 59 and the side of the body opposite the wall 53, these ports being designated P1-P5 from the top down. The upper or first port P1 constitutes an air inlet in communication with the atmosphere, having a bacteriological filter 83 therein for precluding entry of bacteria to the recess 59 in the valve body and thus maintaining sterile conditions in the valve body. The second port P2 from the top is in communication with the air inlet tube 29 for the reservoir or bottle 19 via a flexible plastic tube 85. The third port P3 is interconnected with the outlet tube 33 for the reservoir or bottle 19 via a flexible plastic tube 87. The fourth port P4 is interconnected with the generator inlet tube 13 via a flexible plastic tube 89. The fifth (bottom) port P5 is interconnected with the generator outlet tube 17 via a flexible plastic tube 91 for delivery of eluate to the needle 39. The flexible plastic tubes permit the up and down movement of the valve body.

Figure 3:
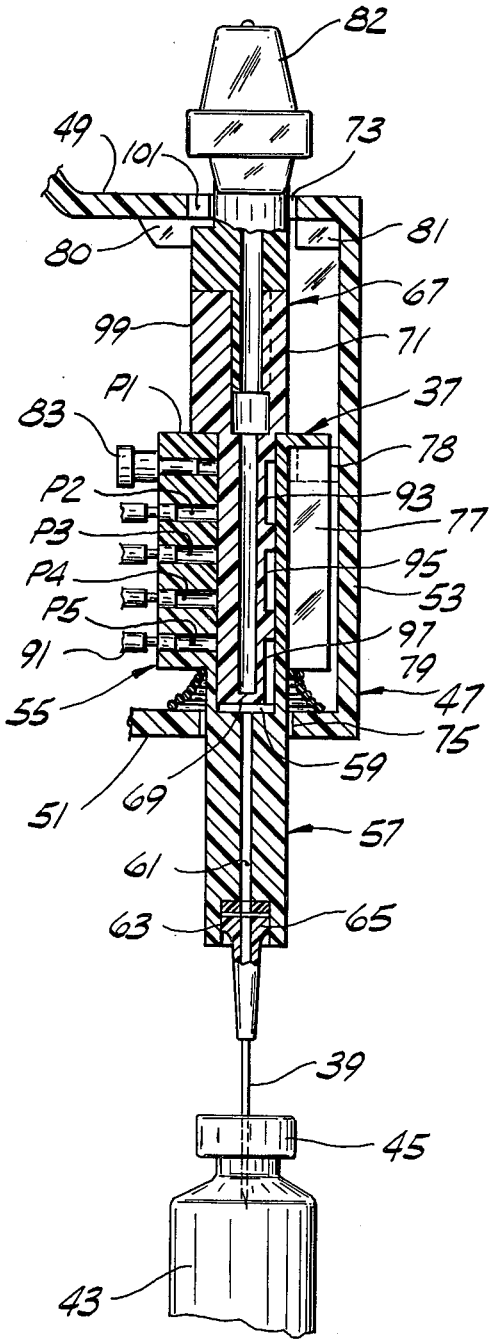
FIG. 3 is a view similar to FIG. 2 showing the valve body and plug pushed down to cause the needle to pierce the stopper of an evacuated container, before turning the plug to open position.
Figure 4:
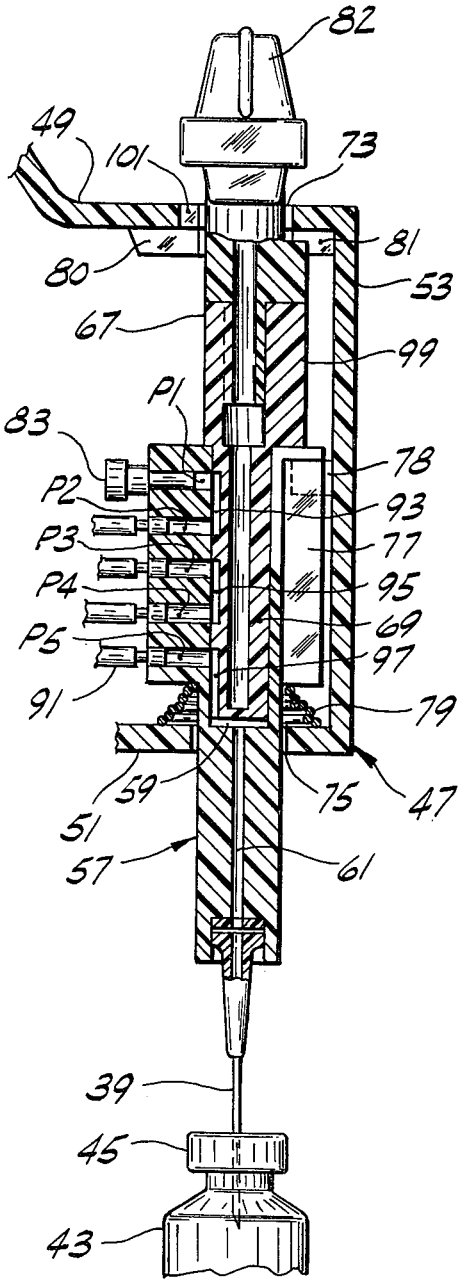
FIG. 4 is a view similar to FIG. 3 showing the valve plug turned to open position.
Figure 5:
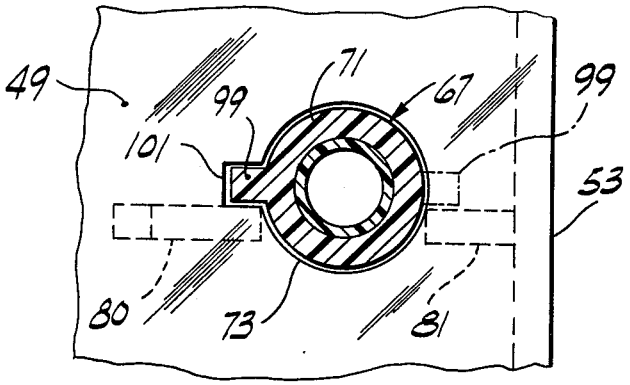
FIG. 5 is a horizontal section on line 5—5 of FIG. 2.

The valve plug 69 is rotatable in the recess 59 of the valve body between a first or closed position (FIGS. 1-3, 5 and 6) wherein it blocks communication between the first and second ports P1 and P2, between the third and fourth ports P3 and P4, and between the fifth port P5 and the needle, and a second or open position (FIG. 4) for communication between the first and second ports P1 and P2, between the third and fourth ports P3 and P4, and between the fifth port P5 and the tubular needle 39. For this purpose, the plug has a first groove 93 for communication between the ports P1 and P2, a second groove 95 for communication between P3 and P4, and a third groove 97 for communication between P5 and the upper end of passage 61, when the plug is turned to its said second or open position. These grooves are located in a radial plane of the plug; this plane comes into the vertical plane of the ports P1-P5 when the plug is rotated to its open position. The plug extension 71 has a key 99 slidable in notch 101 which extends radially outwardly from the opening 73 in the top wall 49 of the overhang. This key prevents rotation of the plug away from its closed position until the knob 81 is pushed down to push down the plug and the valve body to a lowermost position wherein the upper end of the key is below the top wall 49 (see FIGS. 3 and 4). This frees the plug 69 for rotation to its open position. Before the spring 79 can raise the valve body and plug back up to their raised retracted position, the plug must be turned back to its closed position (aligning the key 99 with the notch 101).

The various components of the system are all sterilized before assembly, and assembled under sterile conditions. The valve means 35 is such that it may be readily sterilized. The generator 1, containing the sterile pyrogen-free supply 3 of the parent radioisotope, is placed in a lead shield indicated in phantom at 103 in FIG. 1. The bottle is supplied sealed with the sterile pyrogen-free eluant (e.g., saline solution) therein.

In the use of the system, an evacuated container or vial 43 held in a lead cup (not shown) is placed in position for having the tubular needle 39 driven down through its stopper 41, and the knob 82 is then pushed down to drive the valve plug 69, valve body 37 and needle 39 down to cause the needle to pierce through the stopper of the vial. The knob is pushed down all the way to the point where the upper end of the key 99 is below the top wall 49 of the overhang 47, thereby permitting the valve plug 69 to be turned by turning the knob, and the plug is turned to its open position, which is determined by engagement of key 99 with the stated second stop 81, as indicated in phantom in FIG. 5. The first or closed position of the plug is determined by engagement of the key 99 with the first stop 80 as shown in solid lines in FIG. 5. With the plug in its open position, groove 93 interconnects ports P1 and P2, groove 95 interconnects ports P3 and P4, and groove 97 interconnects port P5 and passage 61 to the needle 39. With ports P1 and p2 interconnected, the eluant in the bottle 19 is subjected to atmospheric air pressure via the bacteriological filter 83, port P1, groove 93, port P2, and tubes 85 and 29, and with vacuum in the vial 43, eluant is caused to flow from the bottle 19 through the outlet tube 33 and tube 87 to port P3, thence through groove 95, port P4, and tubes 89 and 13 to the generator 1 for eluting the daughter radioisotope from the parent radioisotope in the generator. The resultant eluate flows from the generator through its outlet tube 17 and tube 91 to port P5 and thence through groove 97, passage 61 and the tubular needle 39 into the vial 43.

Figure 2:
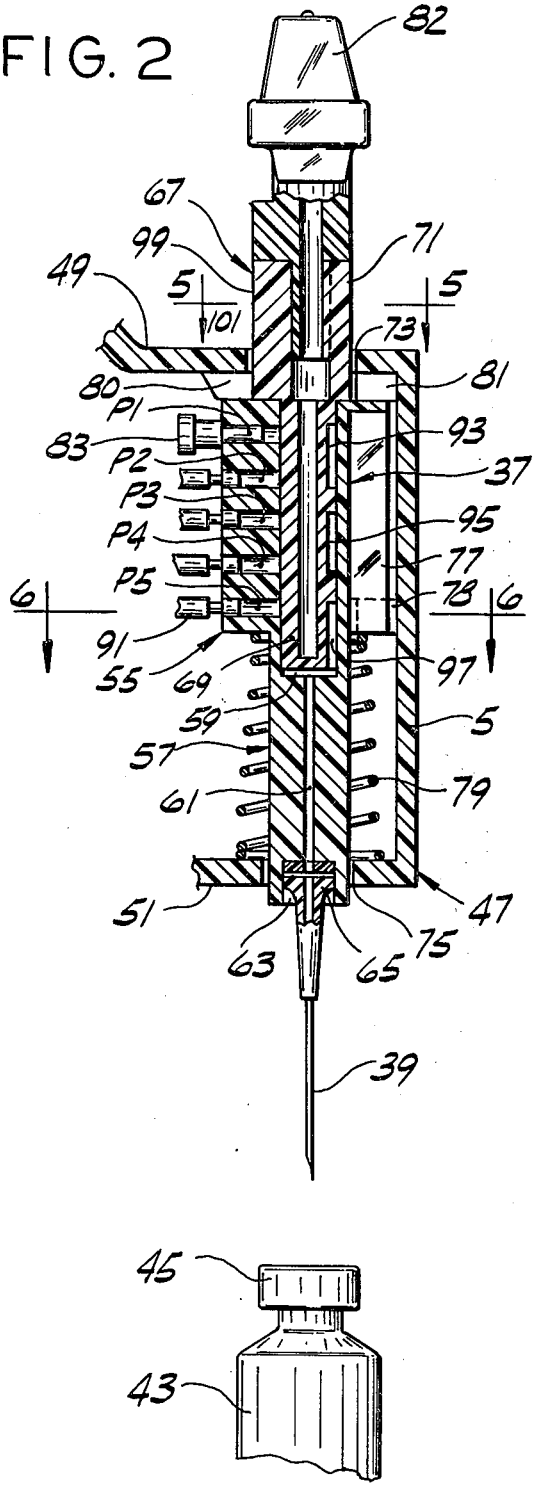
FIG. 2 is an enlarged vertical section of the valve means, showing a valve body and valve plug and needle carried by the valve body in a raised retracted position with the plug in a closed position.

The plug 69 is maintained in its open position until the desired amount of eluate has been suctioned into the vial 43, and is then turned by means of knob 82 to closed position and released to be returned along with the valve body 37 to their raised retracted position of FIGS. 1 and 2. When the plug is turned to closed position, key 99 is aligned with notch 101 to allow the plug (and valve body) to move up (see FIG. 5). The key 99 prevents the valve body and plug from moving upwardly to the raised retracted posiition until the plug is turned to closed position. With the plug in closed position the valve means 35 positively prevents leakage of eluant from the generator 1 by (a) closing off the air vent line 85, 29 to the eluant bottle 19, (b) closing off the eluant line 33, 87 from the bottle to prevent flow of eluant into the generator, and (c) closing off the eluate line 17, 91 from the generator to prevent flow of eluate from the generator to the needle 39.

The valve body 37 and the valve plug 69 of the valve means 35 are preferably molded from a plastic which may be sterilized. Polypropylene is preferred, but polyethylene or styrene may be used. When properly assembled (after sterilization) using aseptic techniques, the valve means remains sterile.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A system for eluting a daughter radioisotope from a parent radioisotope and for containerizing the resultant eluate in an evacuated container having a closure adapted to be pierced by a needle, said apparatus comprising:

a generator containing a supply of the parent radioisotope, said generator having an inlet for an eluant for eluting the daughter radioisotope from the parent radioisotope and an outlet for the resultant eluate;

a reservoir for holding a supply of the eluant, said reservoir having an outlet for delivery of eluant to the inlet of the generator and an air inlet for admission to the reservoir of air from the atmosphere to apply atmospheric air pressure to eluant in the reservoir;

a tubular needle for piercing the closure of an evacuated container;

and valve means comprising a first port constituting an air inlet in communication with the atmosphere, a second port in communication with said reservoir air inlet, a third port interconnected with said reservoir outlet, a fourth port interconnected with said generator inlet, a fifth port interconnected with said generator outlet for delivery of eluate to the needle, and means for blocking communication between said first and second ports, between said third and fourth ports, and between said fifth port and the needle, and operable to place the first port in communication with the second, the third in communication with the fourth and the fifth in communication with the needle.

2. A system as set forth in claim 1 wherein said valve means comprises a valve body carrying the needle, means mounting the valve body for movement downwardly from a raised retracted position for causing the needle to pierce the closure of an evacuated container and for movement upwardly back to its raised retracted position, said ports being in the valve body, and said blocking means comprising a valve member movable with the valve body as it moves downwardly and upwardly and movable relative to the valve body between a first position wherein the second port is blocked from the first, the fourth from the third and the fifth from the needle and a second position wherein the first is in communication with the second, the third is in communication with the fourth and the fifth is in communication with the needle.

3. A system as set forth in claim 2 wherein said valve body has a cylindrical recess extending down from its upper end and a passage extending down from the recess to the lower end of the body, the needle being fitted at its upper end in said passage, said valve member comprising a plug having a rotary sealing fit in said recess and extending upwardly out of said recess, being movable downwardly to move the valve body downwardly for the needle to pierce the closure of an evacuated container and then being rotatable to its second position.

4. A system as set forth in claim 3 wherein the ports extend between the recess and a side of the valve body, with the ports arranged in a vertical series, the plug having a first groove for communication between the first and second ports, a second groove for communication between the third and fourth ports, and a third groove for communication between the fifth port and said passage when the plug is turned to said second position.

5. A system as set forth in claim 4 having means for preventing the plug from being turned from said first to said second position until said plug and valve body have been moved downwardly for the needle to pierce the closure of an evacuated container.

6. A system as set forth in claim 5 having means biasing the valve body and plug upwardly to said raised retracted position, said preventing means preventing the plug from being turned from first to second position until the plug and valve body have been moved downwardly and preventing the valve body and plug from moving upwardly until the plug has been turned back from second to first position.

7. A system as set forth in claim 6 wherein the plug is slidable in an opening in a wall and said preventing means comprises a key on the plug slidable in a notch which extends out from said opening, the upper end of the key being below said wall when the plug is moved downwardly for causing the needle to pierce the stopper of an evacuated container thereby to enable the plug to be turned from the first to the second position.

8. A system as set forth in claim 7 wherein the key is engageable with first and second stops below said wall for determining said first and second positions.

9. A system as set forth in claim 8 having means for guiding the valve body for up and down movement and holding it against rotation.

10. A system as set forth in claim 6 having a bacteriological filter in the first port, a flexible tube interconnecting the reservoir air inlet and the second port, a flexible tube interconnecting the reservoir outlet and the third port, a flexible tube interconnecting the fourth port and the generator inlet, and a flexible tube interconnecting the generator outlet and the fifth port.

* * * * *